US007467497B2

(12) United States Patent
Hockman

(10) Patent No.: US 7,467,497 B2
(45) Date of Patent: Dec. 23, 2008

(54) TOGGLE LOCK FOR SNOW GUARDS OR THE LIKE

(76) Inventor: Mark Hockman, c/o Snow Meister, Box 588, Westtown, PA (US) 19395

( * ) Notice: Subject to any disclaimer, the term of this patent is extended or adjusted under 35 U.S.C. 154(b) by 635 days.

(21) Appl. No.: 11/179,489

(22) Filed: Jul. 13, 2005

(65) Prior Publication Data

US 2006/0010785 A1 Jan. 19, 2006

Related U.S. Application Data

(60) Provisional application No. 60/587,050, filed on Jul. 13, 2004.

(51) Int. Cl.
*E04D 13/10* (2006.01)

(52) U.S. Cl. ..... 52/24; 52/25; 52/26

(58) Field of Classification Search ..... 52/24, 52/25, 26; 248/237, 205.3, 148
See application file for complete search history.

(56) References Cited

U.S. PATENT DOCUMENTS 884,850 A * 4/1908 Peter ..... 52/24
1,463,065 A * 7/1923 Sieger ..... 52/24
2,079,768 A * 5/1937 Levow ..... 52/25
5,222,340 A * 6/1993 Bellem ..... 52/463
5,228,248 A * 7/1993 Haddock ..... 52/25
5,282,340 A * 2/1994 Cline et al. ..... 52/24
5,613,328 A * 3/1997 Alley ..... 52/25
5,732,513 A * 3/1998 Alley ..... 52/25
6,499,259 B1 * 12/2002 Hockman ..... 52/26
6,647,671 B1 * 11/2003 Alley ..... 52/25
6,834,466 B2 * 12/2004 Trevorrow et al. ..... 52/24
7,174,677 B1 * 2/2007 Dressler ..... 52/26
7,213,373 B2 * 5/2007 Hockman ..... 52/24
2005/0193649 A1 * 9/2005 Hockman ..... 52/198
2005/0257434 A1 * 11/2005 Hockman ..... 52/24
2007/0051053 A1 * 3/2007 Hockman ..... 52/25

* cited by examiner

*Primary Examiner*—Richard E. Chilcot, Jr.
*Assistant Examiner*—Chi Q Nguyen
(74) *Attorney, Agent, or Firm*—William E. Jackson; Stites & Harbison PLLC

(57) ABSTRACT

A snow guard which attaches to the vertical leg of a formed metal roof seam utilizing the formed seam and a movable toggle lock to attach the snow guard without the use of penetrations or seam deformations. Roof accessories other than a snow guard can be connected to a raised roof seam using the disclosed movable toggle lock.

5 Claims, 2 Drawing Sheets

TOGGLE LOCK FOR SNOW GUARDS OR THE LIKE

RELATED APPLICATIONS

The present application is based upon and claims the benefit of a Provisional Application Ser. No. 60/587,050, filed Jul. 13, 2004, entitled Toggle Lock Snow Guard.

FIELD OF THE INVENTION

The present invention relates to decorative snow guards and to apparatus for securely mounting a snow guard or other roof accessories on a raised seam metal roof.

BACKGROUND OF THE INVENTION

Snow guards, also called snow brakes, are used for preventing large sheets of ice or snow from sliding and falling from roofs, harming persons standing nearby or striking objects below such as shrubbery, cars or property located about the roof drip.

Typically, snow and ice accumulated on a roof melts or its weight causes it to fall. The snow may melt from above by warmth from the sun, or from below by warmth from the roof. Water flows through the snow and runs along the roof and drips off edges of the roof. Such water frequently causes loss of adhesion between the remaining snow and ice and the roof.

Particularly on standing seam metal roofs, or any metal roof with raised seams, the water makes the roof surface slick, causing heavy sheets of snow or ice to slide along the roof. Snow guards are used so that the snow bank or ice sheets formed on the roof are retained until they melt or slide off the roof in small pieces. Snow guards have been designed for attaching to the flat surface of the roof, and some snow guards have been designed for attaching to the roof seams. Many of the snow guard designs found in the prior art are fashioned to affix to such seams by attachment means which either puncture or deform the roofing material substantially in the operation of the device. Other snow guard devices found in the prior art are of designs which require multiple parts to function.

Multi-part snow guards are relatively expensive. Snow guards which attach to the flat surface of the roof make holes through the roof and promote water entry and destruction of the roof and its supporting surface. Snow guards which use adhesives to mount to the roof can work loose from exposure to the elements, discolor the roofing materials and are not generally preferred. Snow guards which attach to the seams of roofs can penetrate the seams or tend to deform the seams unnecessarily for locking the snow guards on the roof. Examples of such snow guards can be found in prior art which provides for recesses or detents in the construction of the snow brake, which are designed to accept the deformed seam.

A need exists for snow guards which may be easily and inexpensively constructed, and which provide adequate support for snow and adequate locking to formed seams without utilizing substantial deformation of the seams as the primary anchoring point for retention of the snow brake.

DESCRIPTION OF THE PRIOR ART

U.S. Pat. No. 5,282,340 issued Feb. 1, 1994 to Cline et al. illustrates certain problems with the prior art. Cline et al. suggest the use of a set screw which attaches the snow brake to a roof seam and holds it in place by deforming the opposite of the vertical portion of the roofs seam and pressing the displaced seam into a depression or dimple in the snow brake base on the opposite side of the set screw. Other patents, such as U.S. Pat. No. 5,732,513 issued to Williams on Mar. 31, 1998, continue to show deformation of a roof seam by set screws as a primary affixing means of a snow brake. In the Williams '513 patent, the deformation of the seam is necessary by the application of set screw pressure on both sides of a seam thereby creating opposing depressions or displacements of the roof seam sufficient to effectively hold the roof brake to a seam by causing a counter displacement immediately adjacent to a first displacement of the seam by one set screw. In effect, the Williams '513 patent creates opposing recesses of a roof seam by displacing the seam in the opposite direction immediately adjacent to a first displacement by a first set screw. In both the Cline et al. and Williams patents, the attachment screws are visible from the sides of the snow guards.

Such issued patents, as well as prior art patents which teach attachment means for snow guards on existing fabricated metal roof seams, do not teach the firm attachment of snow guards by means of a lock which is engaged against the existing standing seam as more fully described in the present disclosure.

It will be apparent that the snow guard of the present invention has the following advantages over the prior art as exemplified by Cline et al. and Williams: Attachment screws are not on the side(s) of the snow guard, thus not visible on these sides; no penetration of seam is possible from the usual set screws; can be installed in either right or left hand seam orientation; strength of connection of the snow guard to the roof seam is increased as weight of load on the guard is increased.

SUMMARY OF THE INVENTION

The present invention provides a light weight, easily attachable, and simple snow guard for attachment to standing seams commonly used in fabricated metal roofs. The present invention provides an improved attachment means for connection to the roof seams used at the attachment point of metal roofs which are comprised of generally rectangular pieces. The described snow guard attaches through its mounting base by engaging with the existing seam to hold the snow guard onto a standing seam by utilizing a moveable "toggle" lock member attached to the snow guard by a fastener. The present invention relies on a fastener attached to the base of the snow guard to move the movable "toggle" lock into secure engagement with the standing seam. The disclosed snow guard can be used by engaging the standing seam as more fully described in the following disclosure. The disclosed snow guard provides an improvement to the state of the art by not requiring opposing indentations, recesses or openings on the side of the snow guard which would receive any seam engaging fastener such a set screw.

Accordingly, one object of the present invention is to provide a snow guard which has a simplified method of attachment of the guard to a seam in a metal roof.

It is further the object of the invention to provide a snow guard in which the attachment does not rely on a depression or a recess in the snow guard base which is used to compliment the depression formed by the snow guard attachment means in the seam being displaced by the attachment means.

It is a further object of the present invention to provide an attachment device for attaching accessories to the raised seams of a roof.

The novel features that are considered characteristic of the invention are set forth below in the disclosure and claims. The invention itself, both as to its construction and its method of operation, together with additional objects and advantages thereof, will best be understood from the description of specific embodiment which follows when read in conjunction with the accompanying drawings, wherein like numbers refer to like parts. These, and many other objects, will become readily apparent to those skilled in the art of making snow brakes, upon reading the following detailed descriptions which disclose specific embodiments of the invention.

DETAILED DESCRIPTION OF THE PREFERRED EMBODIMENTS

Figure 1:
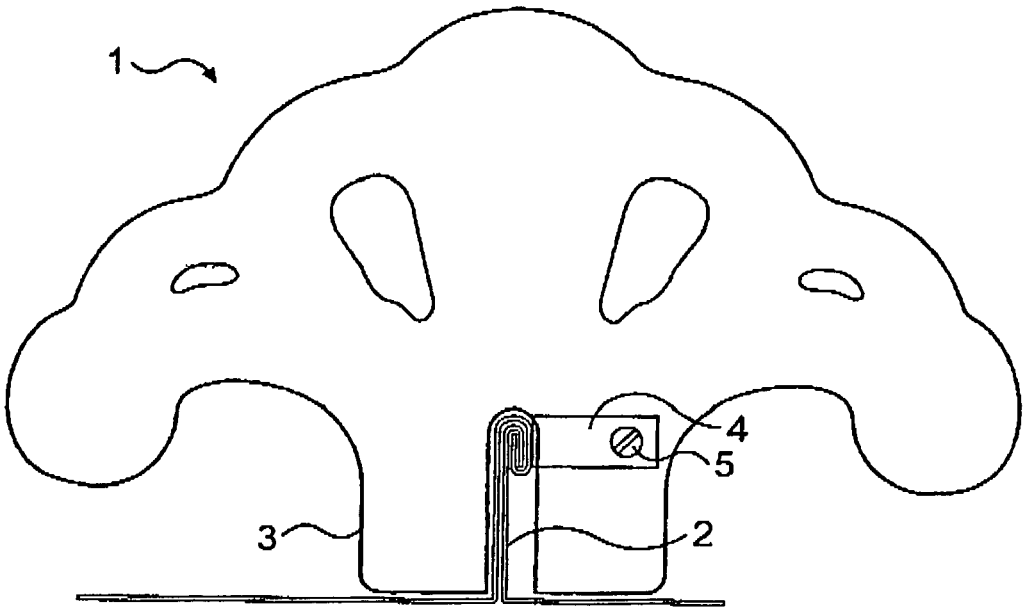
FIG. 1 is an end view of one embodiment of the present invention illustrating the entire snow guard applied to a typical standing seam roof.
Figure 2:
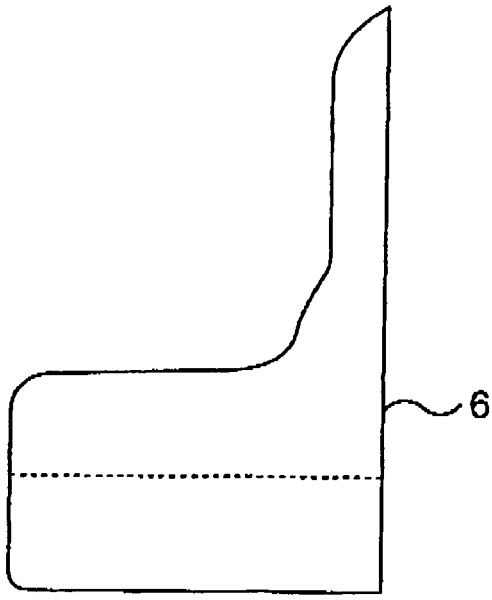
FIG. 2 is a partial view of the snow guard of FIG. 1 as seen from the side.

Reference will now be made to the various Figures wherein like numbers represent like parts. Referring to FIG. 1, an embodiment of the snow guard is generally indicated by the numeral 1 and is attached to raised seam 2. The present invention has several parts which include the snow plate which extends above the snow guard base 3, which has a U shaped seam receiver which includes a top and bottom. The top of seam receiver is the receiver head. Snow guard 1 operates in a conventional fashion in that it prevents the movement of snow and ice upon a roof by contacting a sliding snow or ice mass, thereby interfering with downward movement of the mass. The snow plate normally contacts snow or ice sliding downward off a sloping roof. Snow or ice contacts the snow plate in a generally normal direction thereby transmitting such force through plate to base 3, which is an integral part of the one piece design illustrated in FIG. 1. Such force is thereby transmitted through the base 3 to an angled piece of metal 4 or "toggle lock" more fully illustrated in FIGS. 1, 3 and 4. Screw or bolt 5 attaches the toggle lock to rear surface 6 of the guard as shown generally in FIGS. 1, 3 and 4. When screw or bolt 5 is tightened, it will be appreciated that one end of the toggle lock will contact the outside surface of the raised seam which is situated within the U-shaped seam receiver of base 3. Therefore, force being applied to the snow plate is translated into base 3 and the resulting force is transmitted to the toggle lock 4 and to the roof seam. In normal operation, snow guard 1 is situated on a vertically extending roof seam by toggle lock 4 and friction on the inner surface of the U-shaped seam receiver, thereby preventing movement of snow guard 1 along the seam when the brake is firmly attached as will be more fully described below.

One advantage of the snow guard of the present invention is that it can be applied to right or left seam orientation. The snow guard of the present invention can be fixed to the seam whether rolled on the left side or right side of a given standing seam.

Metal roofs are formed from an array of separate roof panels which interconnect along their lateral edges by what are generally referred to as standing seams. Whether formed on the site by automatic machinery or forming brakes, the standing seams are one of the most commonly found attachment means for connecting adjacent roofing panels. Roof seams are formed by rolling the edges in a fashion which provides for a watertight and secure joint. FIG. 1 illustrates a roof panel standing seam 2 as shown in the figures. Roofing material is attached together using well known procedures to create such a joint.

Figure 3:
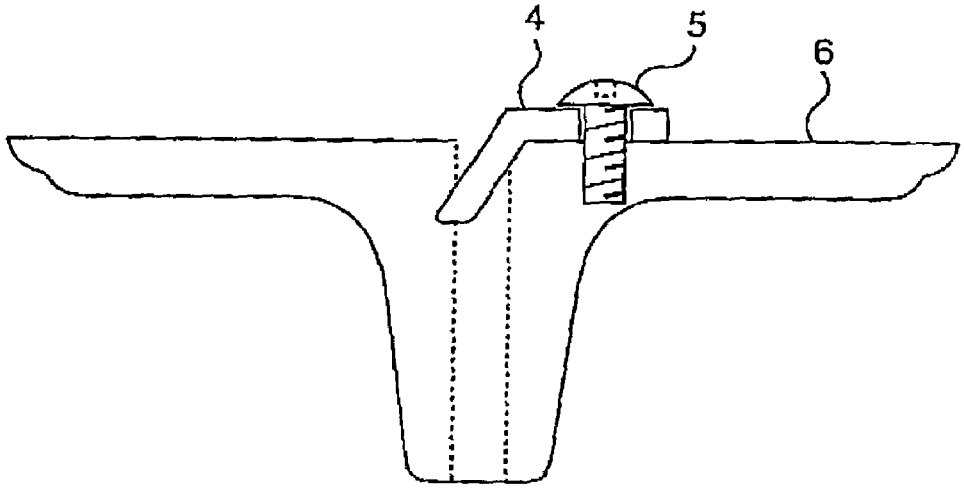
FIG. 3 is a partial top view of the snow guard of FIG. 1.
Figure 4:
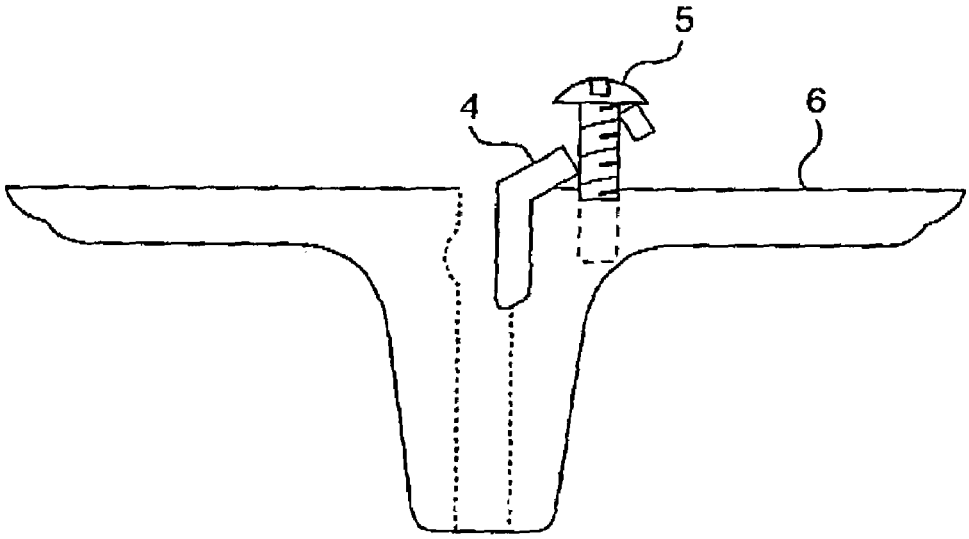
FIG. 4 is an another partial top view of the snow guard of FIG. 1.

FIGS. 1, 3 and 4 also depict an attachment device for attaching roof accessories other than a decorative snow guard to a raised seam. Thus, the base 3 in FIG. 1, may be provided with means to connect (e.g., threaded holes, etc.) to other roof accessories (not shown) such as bars for blocking snow/ice from sliding down the roof.

It can be appreciated from the foregoing description and various embodiments provided that numerous changes or modifications may be made without departing from the spirit or the scope of the invention as defined by the following claims. Although certain preferred embodiments are presented for the purpose of describing the present invention, other species or derivations from the specific embodiment of the invention are to be considered within the scope of the invention.

What is claimed is:

1. A snow guard comprising:

(a) a base with a bottom and a top, the base having a longitudinally extending body with first and second longitudinal ends, a slot extending upward from the bottom toward the top and terminating spaced from the top and extending through the first and second ends for receiving a rolled seam of a metal roof in the slot, the slot dividing the base into first and second opposite sides connected at the top, said first longitudinal end having a hole extending longitudinally for receiving and holding an anchor screw, a movable means for locking said base to a rolled roof seam, said movable means being attached to said end by said anchor screw, said movable locking means being shaped to engage with a rolled roof seam to prevent removal of said snow guard from said seam when said anchor screw forces said movable locking means against said seam of the roof, and (b) a snow guard plate connected to the base and extending laterally beyond the opposite sides of the base and extending upward to beyond the top of the base.

2. A snow guard for attachment to a rolled style of roof seam wherein said seam has a rolled portion forming an asymmetrical head, comprising:

(a) an inverted, rectangular, U-shaped base having a central slot for receiving a rolled seam of a metal roof, first and second sides extending along the central slot and a top interconnecting the sides, said base having one end formed by a plane substantially perpendicular to said central slot, (b) a movable means for locking said base to said roof seam, said movable means being attached to one end of said base and being shaped to engage with said roof seam to prevent removal of said snow guard from raised seam when said movable locking means is forced against said room seam, and (c) a snow plate extending upward from the base, the snow plate having a surface portion extending laterally beyond the sides of the base.

3. The snow guard of claim 2 wherein said means for locking is attached to said base by a means for fastening.

4. An attachment device for mounting a roof accessory to a raised seam roof comprising:

(a) a base with a bottom and a top, the base having a longitudinally extending body with first and second longitudinal ends, a slot extending upward from the bottom toward the top and terminating spaced from the top and extending through the first and second ends for receiving a raised seam of a metal roof in the slot, the slot dividing the base into first and second opposite sides connected at the top, said first longitudinal end having:

a hole extending longitudinally for receiving and holding fastener means, a movable means for locking said base to a raised roof seam, said movable means being attached to said end by said fastener means, said movable locking means being shaped to engage with a rolled seam to prevent removal of said device from said seam when said fastener means forces said movable locking means against said seam, and (b) means connected to said base for connection to said accessory.

5. The invention of claim 4 wherein said means for locking is in the form of an angled element and one leg of said element defines a hole for receiving said fastener means and the other leg of said element engages said seam when said fastener is tightened.

* * * * *